US010319544B2

(12) United States Patent
Vaishnavi et al.

(10) Patent No.: US 10,319,544 B2
(45) Date of Patent: Jun. 11, 2019

(54) BOLTED PRESSURE SWITCH MOTOR ARRANGEMENT

(71) Applicant: Eaton Corporation, Cleveland, OH (US)

(72) Inventors: Romil Vaishnavi, Pune (IN); Douglas Ray Bender, Cleveland, TN (US); Chitra Dattaraya Nanaware, Pune (IN); Somnath Janaba Devarde, Pune (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 56 days.

(21) Appl. No.: 15/625,127

(22) Filed: Jun. 16, 2017

(65) Prior Publication Data

US 2018/0366287 A1 Dec. 20, 2018

(51) Int. Cl.

| | |
|---|---|
| ***H01H 35/38*** | (2006.01) |
| ***H01H 3/26*** | (2006.01) |
| ***H01H 3/42*** | (2006.01) |
| ***H01H 3/38*** | (2006.01) |

(52) U.S. Cl.

CPC ..... *H01H 35/38* (2013.01); *H01H 3/26* (2013.01); *H01H 3/38* (2013.01); *H01H 3/42* (2013.01); *H01H 2003/268* (2013.01)

(58) Field of Classification Search

CPC ..... H01H 35/38; H01H 3/26; H01H 3/38; H01H 3/42; H01H 2003/268; H01H 71/70

USPC ..... 200/82 R, 400, 332

See application file for complete search history.

(56) References Cited

U.S. PATENT DOCUMENTS

| | | | | | |
|---|---|---|---|---|---|
| 2,921,238 | A * | 1/1960 | Wollerton | H01H 75/04 | 361/116 |
| 2,960,186 | A * | 11/1960 | Latour | G05G 25/00 | 185/40 R |
| 3,009,034 | A * | 11/1961 | Barkan | H01H 75/04 | 335/25 |
| 5,508,487 | A * | 4/1996 | Smith | H01H 3/3031 | 200/400 |
| 5,530,215 | A * | 6/1996 | Couvreur | H01H 11/0006 | 200/293 |
| 2003/0015499 | A1* | 1/2003 | Kawamoto | H01H 3/3026 | 218/84 |
| 2010/0059350 | A1* | 3/2010 | Kil | H01H 71/503 | 200/332 |
| 2014/0262714 | A1* | 9/2014 | Ohda | H01H 3/34 | 200/400 |

* cited by examiner

*Primary Examiner* — Edwin A. Leon

(74) *Attorney, Agent, or Firm* — Benesch Friedlander Coplan & Aronoff LLP

(57) ABSTRACT

An electrical switch assembly includes a first contact supported for movement into and out of electrical connection with a second contact. A cam assembly is configured to deflect a spring into a stressed condition, and to move the first contact into electrical connection with the second contact under a bias of the spring upon return deflection of the spring from the stressed condition. A motor has an output member. A linkage interconnects the output member with the cam assembly to deflect the spring into the stressed condition in response to movement of the output member.

9 Claims, 4 Drawing Sheets

BOLTED PRESSURE SWITCH MOTOR ARRANGEMENT

TECHNICAL FIELD

This technology relates to an apparatus that shifts a bolted pressure switch assembly between OPEN and CLOSED conditions under the biasing forces of springs.

BACKGROUND

Electrical switches are often used to act as a main disconnect for commercial and industrial applications. The switch has to make and break the current at the contacts safely to ensure electrical connection and disconnection of the circuit. Since the switches are to make and break on load, an operating mechanism is incorporated before the contacts so as to first store the energy inside the mechanism by means of spring-linkage system, and to then let the mechanism release the stored energy to the contacts to make or break the current at some pre-determined velocities. Traditionally, an external handle is connected to the mechanism shaft and the energy to the mechanism is supplied manually by human effort.

SUMMARY

In embodiments described below, an apparatus includes an electrical switch assembly and a cam assembly. The switch assembly includes a first contact supported for movement into and out of electrical connection with a second contact. The cam assembly deflects a spring into a stressed condition. The cam assembly also moves the first contact into electrical connection with the second contact under a bias of the spring upon return deflection of the spring from the stressed condition. The apparatus further includes a motor having an output member. A linkage interconnects the output member with the cam assembly to deflect the spring into the stressed condition in response to movement of the output member.

In distinction from a manually operated handle, the motor can provide greater amounts of energy to be stored in the spring. Additionally, the motor can be actuated by wireless or other actuation means located remotely from the switch assembly for enhanced user safety.

In the given examples, the apparatus further includes a frame having an outer periphery configured for fitting within a switchboard cubicle. The motor and linkage are contained within the outer periphery of the frame to ensure a proper fit within the switchboard cubicle.

DETAILED DESCRIPTION

Figure 1:
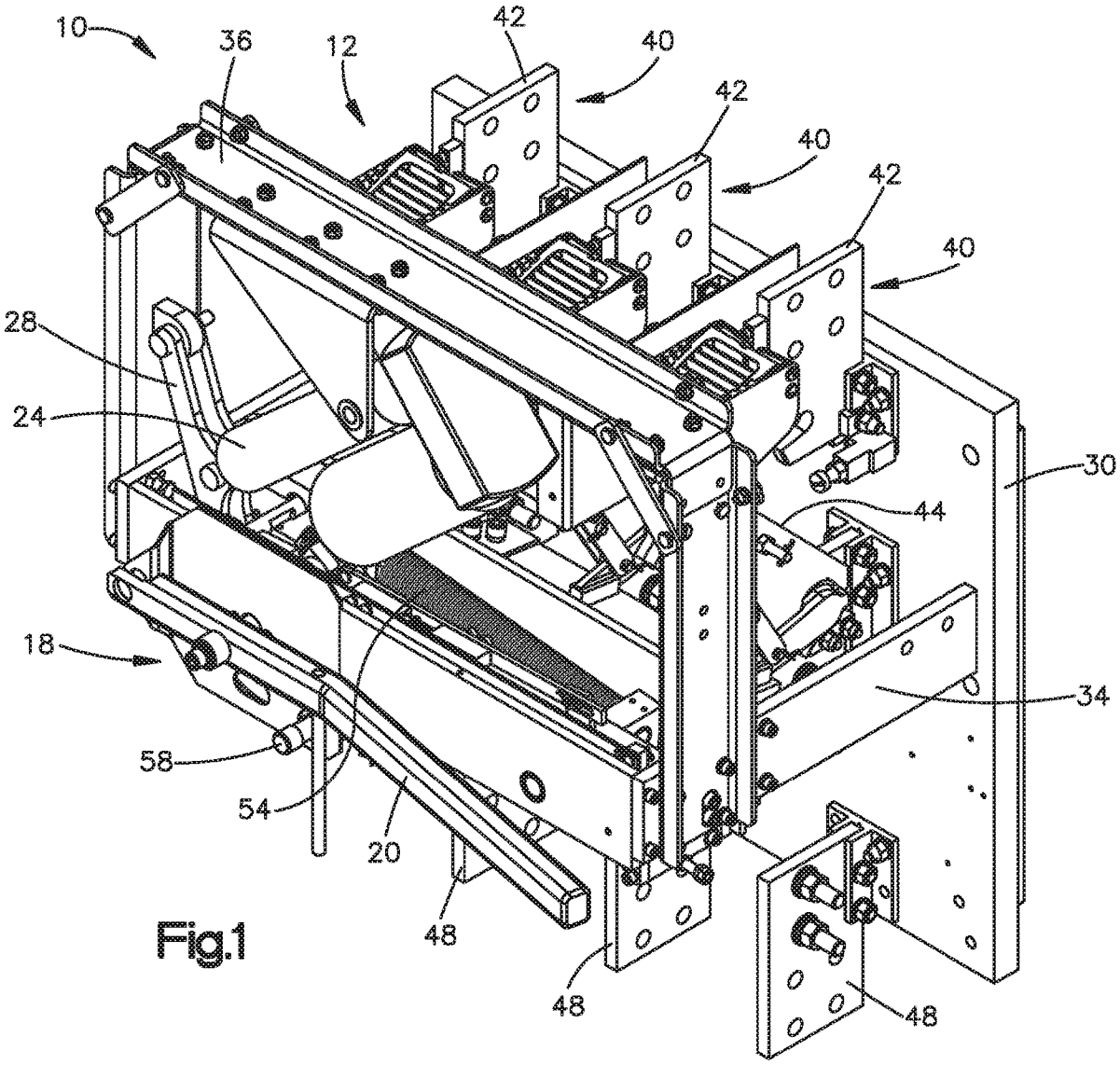
FIG. 1 is a perspective view of an electrical switch assembly and an apparatus that shifts the switch assembly between OPEN and CLOSED conditions under the biasing forces of springs.

The apparatus illustrated in the drawings includes parts that are examples of the elements recited in the claims. The illustrated apparatus thus includes examples of how a person of ordinary skill in the art can make and use the claimed invention. These examples are described to meet the enablement and best mode requirements of the patent statute without imposing limitations that are not recited in the claims.

As shown in FIG. 1, an apparatus 10 includes an electrical switch assembly 12. An actuator mechanism 18 is operatively interconnected with the switch assembly 12. The actuator assembly 18 has a manually operable handle 20 for shifting the switch assembly 12 between OPEN and CLOSED conditions. A motor 24 and a linkage 28 also are provided for shifting the switch assembly 12 between the OPEN and CLOSED conditions.

The apparatus 10 is sized and shaped for installation in a switchboard (not shown) which, as known in the art, includes a cubicle for containing a switch assembly. The switch assembly 12 of FIG. 1 is thus supported on a base panel 30 that is sized and shaped with reference to a switchboard cubicle. The motor 24 and the linkage 28 are supported on a frame 34 that projects from the base panel 30. In the illustrated example, the motor 24 and the linkage 28 are supported on a front portion 36 of the frame 34. The front portion 36 of the frame 34 has an outer periphery that is sized and shaped to fit closely within an inner periphery of the switchboard cubicle.

Figure 2:
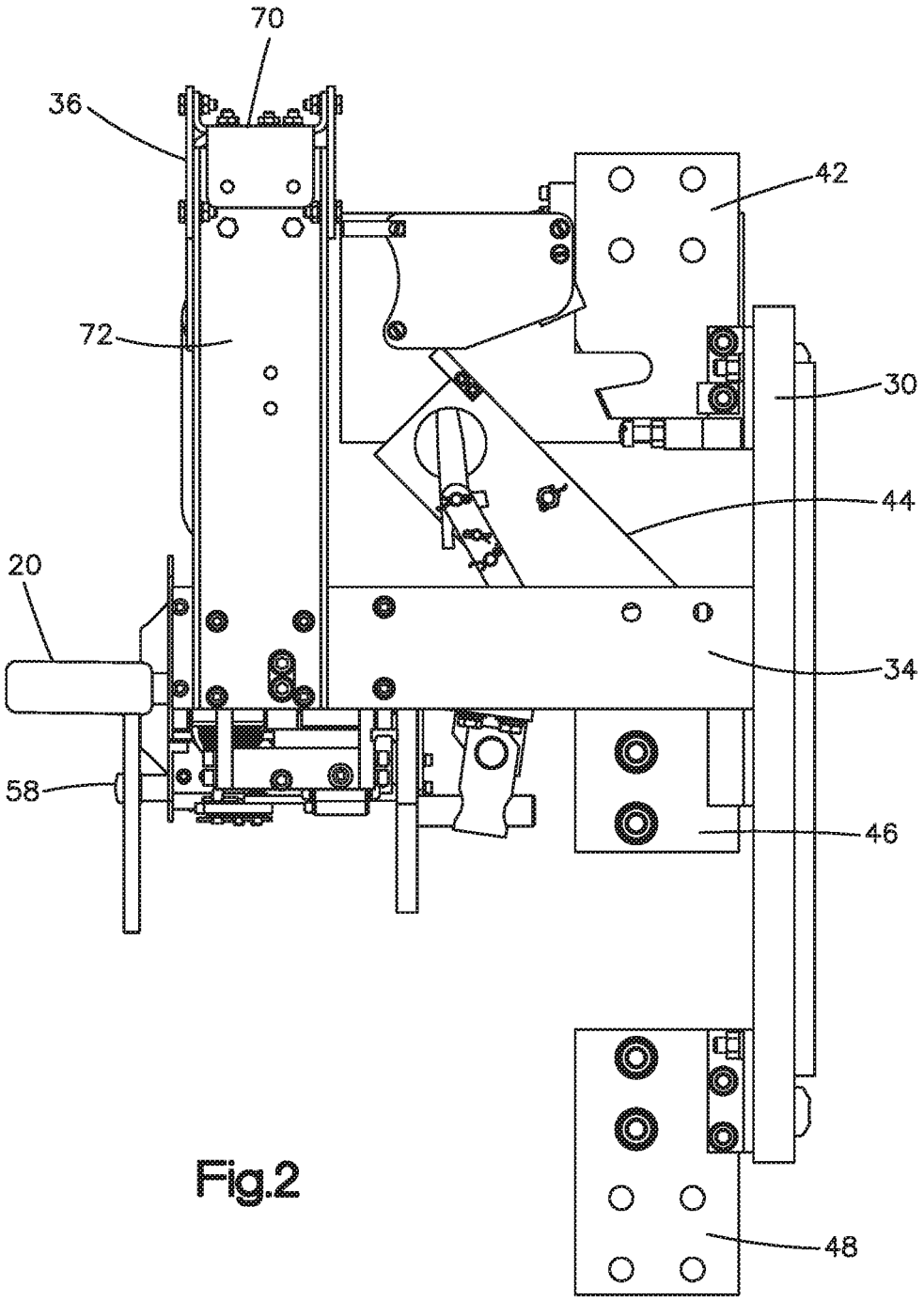
FIG. 2 is a side view of the apparatus of FIG. 1.

This particular example of a switch assembly 12 is known as a bolted pressure switch assembly. As shown in FIG. 2, the switch assembly 12 includes three sets 40 of electrical contacts. Each set 40 includes an upper stationary contact 42, a movable contact 44, and an intermediate stationary contact 46. Lower stationary contacts 48 also are included. The movable contacts 44 are supported to pivot from open positions, as shown for example in FIG. 2, to closed positions in electrical contact with both the upper and intermediate stationary contacts 42 and 46. This shifts the switch assembly 12 from the OPEN condition to the CLOSED condition. Fuses (not shown) would be installed to complete electrical current paths from the intermediate stationary contacts 46 to corresponding lower stationary contacts 48.

The actuator mechanism 18 is operatively interconnected with the motor 24 and the linkage 28, but is otherwise configured as known in the art. As shown partially in FIG. 4, the actuator assembly 18 thus includes an actuator shaft 50, a cam assembly 52, and a pair of springs 54. The shaft 50 is supported for rotation about an axis 55. The cam assembly 52 acts between the shaft 50 and the springs 54 to store and release energy in the springs 54.

In operation, the shaft 50 is rotated from a first position to a second position. The shaft 50 can be rotated either manually by use of the handle 20 or automatically by use of the motor 24 and the linkage 28. When the shaft 50 is rotating toward the second position, the cam assembly 52 first compresses one of the springs 54, and then latches the compressed spring 54 in a stressed condition. The shaft 50 is next rotated back to the first position. When the shaft 50 is rotating back toward the first position, the compressed spring 54 remains latched, and the cam assembly 52 compresses the other spring 54 to a stressed condition. However, the cam assembly 52 does not latch the other spring 54 in the compressed condition. Instead, the cam assembly 52 releases the other spring 54 to snap back from the compressed condition. The return movement of the other spring 54 drives the cam assembly 52 to shift the switch assembly 12 from the OPEN condition to the CLOSED condition under the bias of the released spring 54. The actuator mechanism 18 further includes a release button 58 (FIG. 1) for releasing the latched spring 54, which then drives the cam assembly 52 to shift the switch assembly 12 back to the OPEN condition in a known manner.

Figure 3:
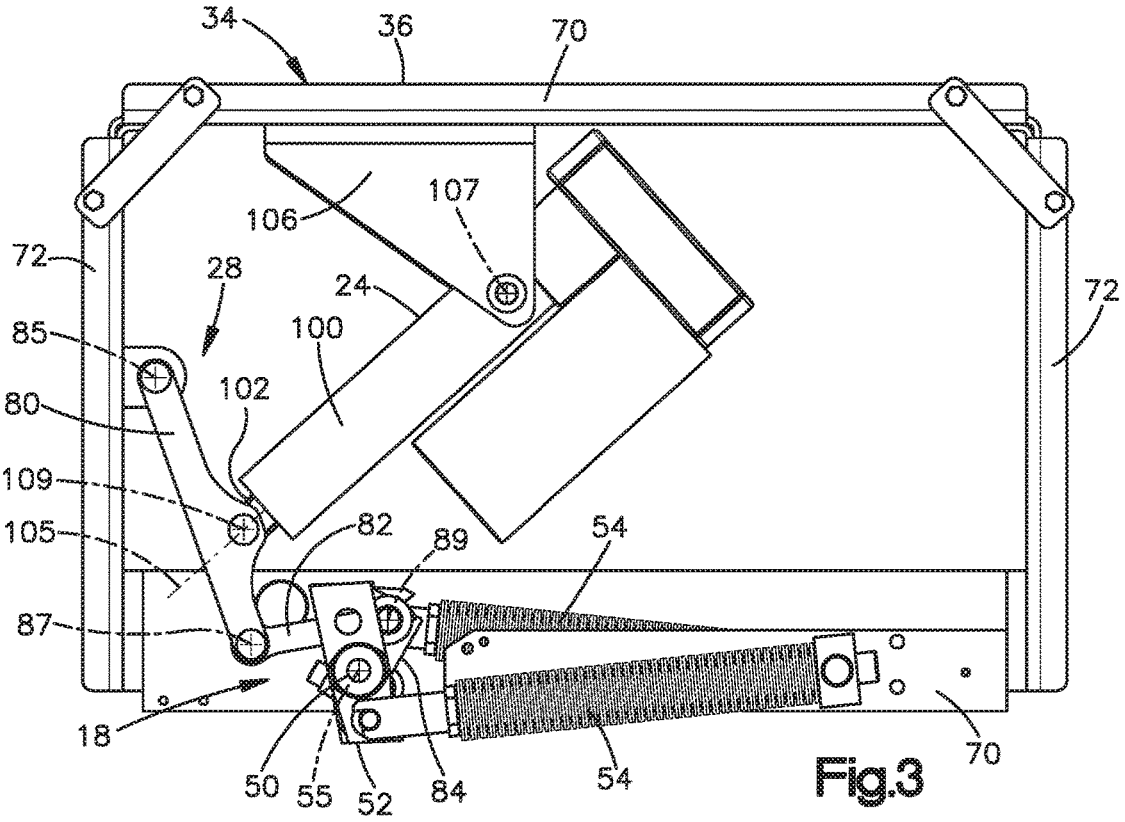
FIG. 3 is an enlarged front view of the apparatus of FIG. 1, with certain parts omitted for clarity of illustration.

As best shown in FIGS. 1 and 3, the front portion 36 of the frame 34 has a rectangular outer periphery defined by upper and lower side sections 70 reaching longitudinally between transverse opposite end sections 72. The actuator mechanism 18 is supported on the lower side section 70 of the frame 34. The motor 24 is supported on the upper side section 70. The linkage 28 extends from an end section 72 of the frame 34 to the actuator mechanism 18 on the lower side section 70. Arranging and containing the motor 24 and the linkage 28 within the outer periphery of the frame 34 in this manner helps to ensure that the entire apparatus 10 will fit properly within the inner periphery of the switchboard cubicle.

The linkage 28 includes first, second and third links 80, 82 and 84. The first link 80 is anchored to the end section 72 of the frame 34, and is movable pivotally about an axis 85. The second link 82 interconnects the first and third links 80 and 84 through couplings having respective pivotal axes 87 and 89. The third link 84 interconnects the second link 82 with the rotatable shaft 50 at the cam assembly 52. The pivotal axes 85, 87 and 89 in the linkage 28 are all parallel to the rotational axis 55 of the shaft 50.

This example of a motor is a linear actuator having a fluid piston-cylinder 100 with an output shaft 102 that is driven to reciprocate along an axis 105. A bracket 106 is fixed to the upper side section 70 of the frame 34. The motor 24 is supported on the bracket 106 for pivotal movement about an axis 107 that also is parallel to the axis 55 at the rotatable shaft 50. The output shaft 102 is coupled to the first link 80 for movement about another parallel pivotal axis 109.

Figure 4:
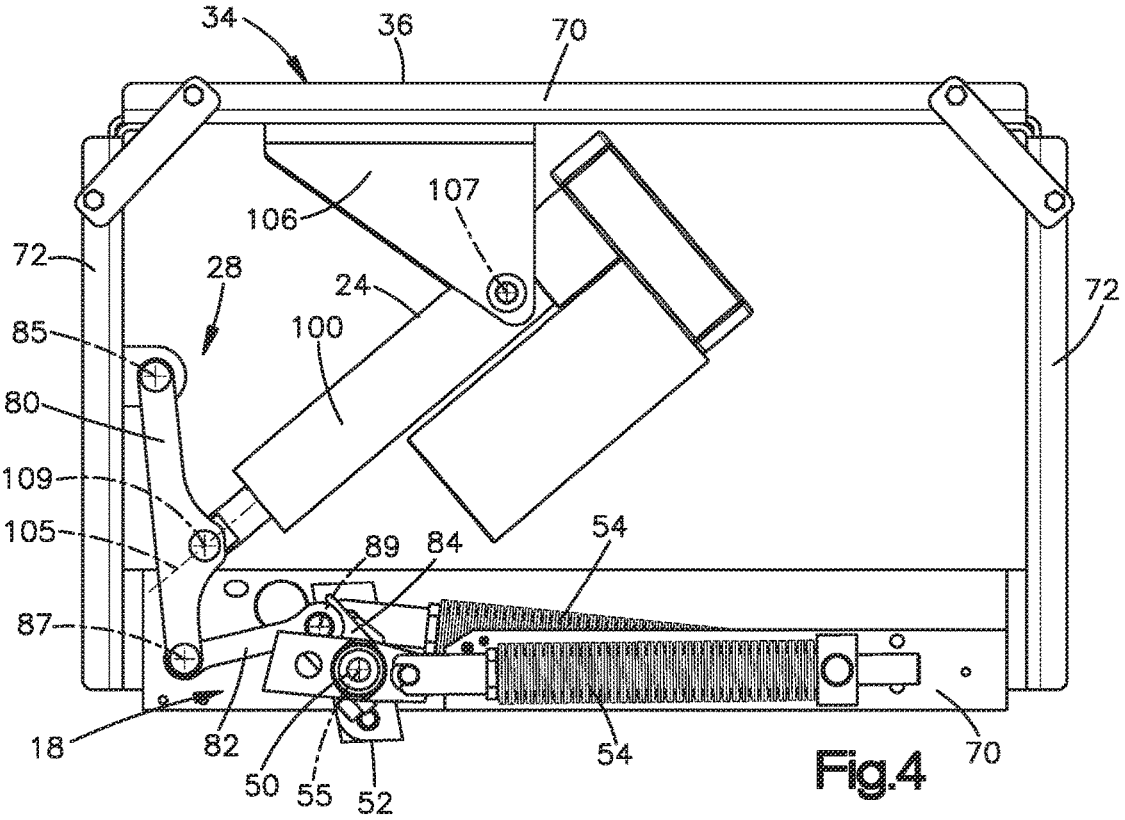
FIG. 4 is a view showing the parts of FIG. 3 in different positions.

When the motor 24 is actuated to extend the output shaft 102 outward from the piston-cylinder 100, the output shaft 102 moves the linkage 28 from the condition of FIG. 3 toward the condition of FIG. 4. The third link 84 then rotates the shaft 50 such that the cam assembly 52 compresses and latches one of the springs 54, as described above. When the output shaft 102 is next retracted toward the position of FIG. 3, the cam assembly 52 stresses and releases the other spring 54 to shift the switch assembly 12 into the CLOSED condition under the bias of the released spring 54, also as described above.

The linkage 28 can be disconnected if the handle 20 is to be used instead of the motor 24. This can be accomplished, for example, by disconnecting second link 82 from the third link 84. However, in distinction from the handle 20, the motor 24 can provide greater amounts of energy to be stored in the springs 54. Additionally, the motor 24 can be actuated in the forgoing manner by the use of any suitable actuation means known in the art, including wireless or other actuation means that can be located remotely from the switch assembly 12 for enhanced user safety.

Figure 5:
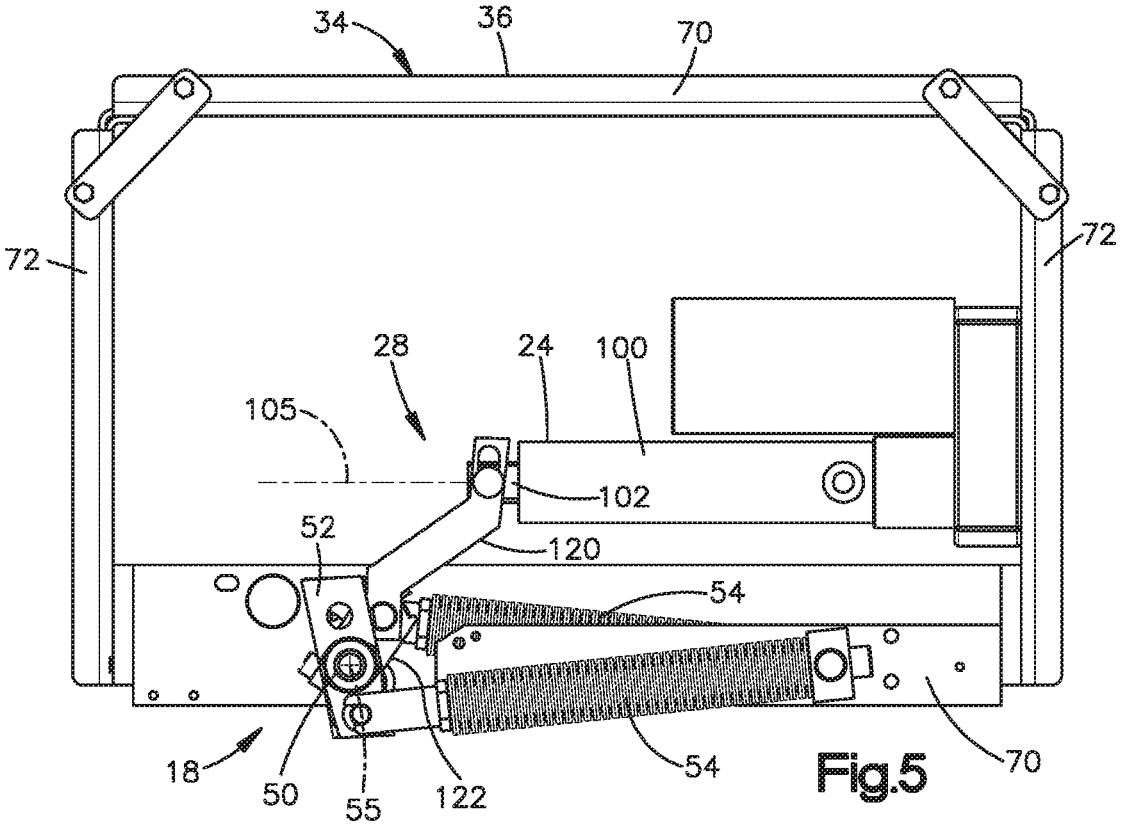
FIG. 5 is a view similar to FIG. 4, showing an alternative embodiment of the apparatus.
Figure 6:
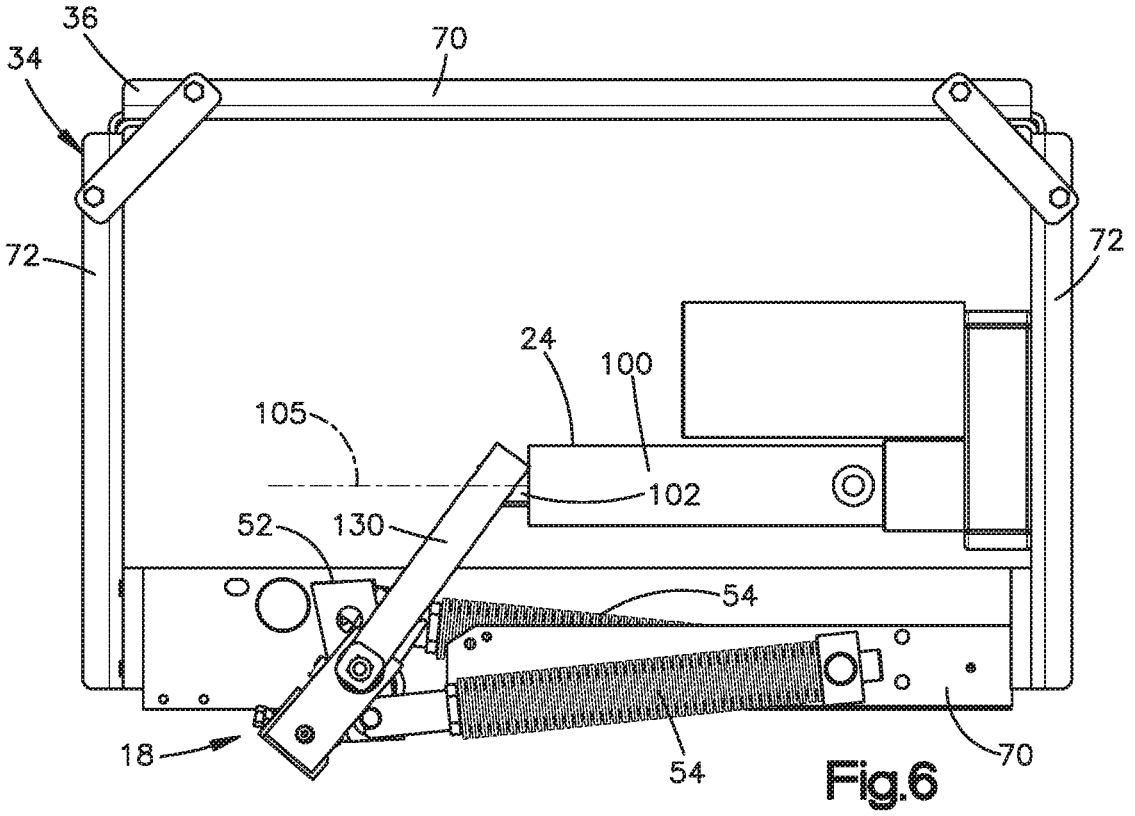
FIG. 6 also is a view similar to FIG. 4, showing another alternative embodiment.

Another embodiment is shown partially in FIG. 5. In this embodiment, the motor 24 and linkage 28 extend in series from the frame 34 to the actuator mechanism 18. The motor 24 is fixed to an end section 72 of the frame 34. The linkage 28 includes first and second pivotally coupled links 120 and 122 reaching from the output shaft 102 to the actuator shaft 50. The embodiment of FIG. 6 is similar, but the linkage 28 includes an L-shaped link 130 reaching to the front side of the frame 34 to engage the actuator shaft 50 at that location.

This written description sets for the best mode of carrying out the invention, and describes the invention so as to enable a person of ordinary skill in the art to make and use the invention, by presenting examples of the elements recited in the claims. The detailed descriptions of those examples do not impose limitations that are not recited in the claims, either literally or under the doctrine of equivalents.

What is claimed is:

1. An apparatus comprising:

an electrical switch assembly including a first contact supported for movement into and out of electrical connection with a second contact;

a spring;

a cam assembly configured to deflect the spring into a stressed condition, and to move the first contact into electrical connection with the second contact under a bias of the spring upon return deflection of the spring from the stressed condition;

a motor having an output member;

a linkage interconnecting the output member with the cam assembly to deflect the spring into the stressed condition in response to movement of the output member; and a frame having a rectangular periphery defined by a side section, an opposite side section, an end section, an opposite end section, and four corners where the side sections meet the end sections;

wherein the motor is mounted on the side section of the frame for movement pivotally relative to the frame;

the cam assembly and the spring are mounted on the opposite side section of the frame for movement pivotally relative to the frame; and the linkage includes a pivotal link anchored to an end section of the frame between the side sections.

2. An apparatus as defined in claim 1 wherein the output member is coupled to the pivotal link for movement pivotally relative to the pivotal link.

3. An apparatus as defined in claim 1 wherein the linkage further includes additional pivotal links that interconnect the cam assembly with the pivotal link that is anchored to the end section of the frame.

4. An apparatus as defined in claim 1 further comprising a second spring, wherein the cam is configured to deflect the second spring into a stressed condition, and to move the first contact out of electrical connection with the second contact upon return deflection of the second spring from the stressed condition, and wherein the second spring also is mounted on the opposite side section of the frame for movement pivotally relative to the frame.

5. An apparatus comprising:

an electrical switch assembly including a first contact supported for movement into and out of electrical connection with a second contact;

a spring;

a cam assembly configured to deflect the spring into a stressed condition, and to move the first contact into electrical connection with the second contact under a bias of the spring upon return deflection of the spring from the stressed condition;

a motor having an output member;

a linkage interconnecting the output member with the cam assembly to deflect the spring into the stressed condition in response to movement of the output member; and a frame having a rectangular periphery defined by a side section, an opposite side section, an end section, an opposite end section, and four corners where the side sections meet the end sections;

wherein the motor is mounted on the side section of the frame for movement pivotally relative to the frame;

the cam assembly and the spring are mounted on the opposite side section of the frame for movement pivotally relative to the frame;

the linkage includes links that are interconnected by pivotal couplings, and the interconnected links reach from the output member to the cam assembly within the rectangular periphery of the frame.

6. An apparatus as defined in claim 5 wherein the linkage includes a pivotal link anchored to the end section of the frame at a location between the side sections.

7. An apparatus as defined in claim 6 wherein the output member is pivotally coupled to the pivotal link that is anchored to the end section of the frame.

8. An apparatus as defined in claim 6 wherein the linkage further includes additional pivotal links that interconnect the cam assembly with the pivotal link that is anchored to the end section of the frame.

9. An apparatus as defined in claim 5 further comprising a second spring, wherein the cam is configured to deflect the second spring into a stressed condition, and to move the first contact out of electrical connection with the second contact upon return deflection of the second spring from the stressed condition, and the second spring also is mounted on the opposite side section of the frame for movement pivotally relative to the frame.

* * * * *